US005958861A

United States Patent [19]

Durbut et al.

[11] Patent Number: 5,958,861

[45] Date of Patent: Sep. 28, 1999

[54] LIQUID CLEANING COMPOSITIONS CONTAINING A LEWIS NEUTRAL BASE POLYMER

[75] Inventors: Patrick Durbut, Verviers; Anne-Marie Misselyn, Villers-I'eveque; Guy Broze, Grace-Hollogne, all of Belgium

[73] Assignee: Colgate Palmolive Company, NY, N.Y.

[21] Appl. No.: 08/921,495

[22] Filed: Sep. 2, 1997

Related U.S. Application Data

[63] Continuation-in-part of application No. 08/759,654, Dec. 6, 1996, abandoned.

[51] Int. Cl.[6] ..... C11D 17/00; C11D 9/00

[52] U.S. Cl. ..... 510/365; 510/405; 510/424; 510/432; 510/500; 510/430

[58] Field of Search ..... 510/424, 426, 510/428, 238, 425, 500, 430, 405, 481, 365, 421, 524

[56] References Cited

U.S. PATENT DOCUMENTS

| | | | |
|---|---|---|---|
| 5,108,643 | 4/1992 | Loth et al. | 510/238 |
| 5,486,307 | 1/1996 | Misselyn et al. | 510/365 |
| 5,523,025 | 6/1996 | Erilli | 510/417 |
| 5,531,938 | 7/1996 | Erilli | 510/417 |
| 5,604,195 | 2/1997 | Misselyn et al. | 510/400 |
| 5,733,860 | 3/1998 | Durbut et al. | 510/405 |
| 5,736,496 | 4/1998 | Durbut et al. | 510/235 |

*Primary Examiner*—Necholus Ogden
*Attorney, Agent, or Firm*—Richard E. Nanfeldt; James M. Serafino

[57] ABSTRACT

All purpose cleaning compositions which comprise an analephotropic negatively charged complex, optionally, a Lewis base, neutral polymer, and water.

2 Claims, No Drawings

LIQUID CLEANING COMPOSITIONS CONTAINING A LEWIS NEUTRAL BASE POLYMER

RELATED APPLICATION

This application is a continuation in part application of U.S. Ser. No. 8/759,654 filed Dec. 6, 1996 now abandoned.

FIELD OF THE INVENTION

The present invention relates to an all purpose hard surface cleaning composition containing an analephotropic negatively charged complex.

BACKGROUND OF THE INVENTION

This invention relates to an improved all-purpose liquid cleaner designed in particular for cleaning hard surfaces and which is effective in removing grease soil and/or bath soil and in leaving unrinsed surfaces with a shiny appearance.

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

The instant invention solves this problem by delivering on the solid surface to be cleaned the proper surfactant mixture that best adsorbs on the surface while keeping a good "leaving" character.

The analephotropic complex adsorbs much better on grease than on silica surface than individual anionic surfactants alone. This results in enhanced capabilities to disperse complex mixtures of grease with embedded particles of soil which are essential for particulate soil removal.

As illustrated in the examples, it is essential that the analephotropic mixture is negatively charged. Pseudo-nonionic surfactants resulting from anionic-cationic complexes which are not negatively charged show very low particulate soil removal.

SUMMARY OF THE INVENTION

The present invention provides an improved, clear, liquid cleaning composition having improved interfacial tension which improves cleaning hard surfaces such as plastic, vitreous and metal surfaces having a shiny finish, oil stained floors, automative engines and other engines. More particularly, the improved cleaning compositions exhibit good grease soil removal properties due to the improved interfacial tensions, and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products.

Surprisingly, these desirable results are accomplished even in the absence of polyphosphate or other inorganic or organic detergent builder salts and also in the complete absence or substantially complete absence of grease-removal solvent.

In one aspect, the invention generally provides a stable, clear all-purpose, hard surface cleaning composition especially effective in the removal of oily and greasy oil. The cleaning composition includes, approximately by weight:

(a) 3 to 40 wt. %, more preferably 5 to 20 wt. % of an analephotropic negatively charged complex comprising at least one an alkali metal salt or an alkaline earth metal salt of a sulfate or sulfonate anionic surfactant and mixtures thereof being complexed with a nonionic surfactant, wherein the concentration of the analephotropic complex of the anionic surfactant and nonionic surfactant is less than 1.5 mmol of the complex/liter of water at an adhesion tension of 10 mN/m on shiny and flat solid layer of tripalmitin grease (glycerol tripalmitate) at 25° C.;

(b) 0 to 10%, more preferably 0.5% to 9%, of a Lewis base, neutral polymer;

(c) 0 to 2.5%, more preferably 0.1% to 2.0% of a fatty acid having about 14 to about 22 carbon atoms;

(d) about 0 to about 0.25% of a perfume; and (e) the balance being water, said proportions being based upon the total weight of the composition.

Analephotropy means a composition of at least 2 surfactants that cannot be separated by adsorption (at the water-oil surface or water-grease interface).

Analephotropy is observed when a mixture of surfactants adsorbs at the water oil surface or of the water-grease surface at a lower concentration than each surfactant tested alone.

It implies the existence of the formation of a kind of complex between the two surfactants at the interface at which they adsorb together when forming adsorbed layer. This complex is more hydrophobic than each surfactant.

The instant compositions excluded the use of anionic polymers and cationic polymers and cationic surfactants and zwitterionic surfactants as well as cosurfactants such as glycol ethers and the instant compositions do not contain grease release agents such as choline chloride or a mixture of an ethoxylated glycerol with the mono-, di- and tri-esters of the ethoxylated glycerol, or more than 0.35 wt. % of a perfume and the instant compositions are not microemulsions.

DETAILED DESCRIPTION OF THE INVENTION

The present invention relates to a stable all purpose cleaning composition comprising approximately by weight: 3% to 40% of an analephotropic negatively charged complex, wherein the concentration of the analephotropic complex of the anionic surfactant and nonionic surfactant is less than 1.5 mmol of the complex/liter of water at an adhesion tension of 10 mN/m, 0 to 2.5% of a fatty acid having about 14 to about 22 carbon atoms, 0 to 10% of a Lewis base neutral polymer; and the balance being water. The instant compositions excluded the use of anionic polymers and cationic polymers and zwitterionic surfactants as well as cosurfactants such as glycol ethers and the instant compositions do not contain grease release agents such as choline chloride or a mixture of an ethoxylated glycerol with the mono-, di- and tri-esters of the ethoxylated glycerol, or more than 0.35 wt. % of a perfume and the instant compositions are not microemulsions.

One of the objects of the instant invention is to deliver higher proportions of anionic surfactant in the adsorbed layer at the solid-water interface. This is due to a boosted adsorption tendency and a closer 2-D packing by means of association between the negative charge of the anionic surfactant and the nonionic surfactant that is used in admixture with the anionic surfactant in the instant compositions. Two anionic surfactants can be used in composition wherein one of the anionic surfactants will possibly preferentially associate with the nonionic surfactant. If two anionic surfactants are present, there could be a hydrophilic-lipophilic interaction between the two anionic surfactants which will contribute to the 2-D packing at the solid-water interface. As a result of the association between anionic and nonionic surfactants, the minimum concentration required to provide a given adhesion tension at solid grease (glycerol tripalmitate)-water interface with mixtures thereof is reduced versus the concentration required with individual surfactants. A typical value for the adhesion tension is 10 mN/m that corresponds to an already good coverage of the interface, and to the formation of the 2-D packing of surfactant molecules in the adsorbed layer. As well known in the art adhesion tension is defined as the net force exerted by a solid on a liquid at the wetting line and depends upon the contact angle θ which the liquid makes on the solid substrate at the equilibrium. The adhesion tension is defined as the cosine of the contact angle θ that the liquid composition makes with the substrate times the surface tension of the liquid composition $\gamma_L$ as measured at 25° C. on a weakly polar solid substrate which is glycerol tripalmitate. The concentrations needed to deliver an adhesion tension of 10 mN/m at the grease surface are called C10s. The instant liquid compositions exhibit a superior adhesion tension increase efficacy, as measured by the value of the C10 concentrations that are below the C10s of the individual surfactants.

The analephotropic negatively charged complex contained in the instant compositions comprises a complex of:

(a) at least one anionic surfactant which is an alkali metal salt or an alkaline earth metal salt of a sulfonate or sulfate surfactant; and (b) a nonionic surfactant, wherein the ratio of the anionic surfactant to the nonionic surfactant is 5:1 to 0.2:1, more preferably 2:1 to 0.4:1. The instant composition contains about 3 to about 40 wt. %, more preferably about 5 to about 20 wt. % of the analephotropic negatively charged complex.

Suitable water-soluble, anionic surfactants include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, or magnesium, with the sodium and magnesium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other examples of suitable anionic sulfonate surfactants are the paraffin sulfonates containing 10 to 20, preferably 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Examples of satisfactory anionic sulfate surfactants are the $C_8$–$C_{18}$ alkyl sulfate salts and the $C_8$–$C_{18}$ alkyl sulfate salts and the $C_8$–$C_{18}$ alkyl ether polyethenoxy sulfate salts having the formula $R(OC_2H_4)_nOSO_3M$ wherein n is 1 to 12, preferably 1 to 5, and M is a metal cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

On the other hand, the alkyl ether polyethenoxy sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These surfactants can be prepared by reacting an alkyl phenol with 2 to 6 moles of ethylene oxide and sulfating and neutralizing the resultant ethoxylated alkylphenol.

Other suitable anionic surfactants are the $C_9$–$C_{15}$ alkyl ether polyethenoxyl carboxylates having the structural formula $R(OC_2H_4)_nOXCOOH$ wherein n is a number from 4 to 12, preferably 5 to 10 and X is selected from the group consisting of

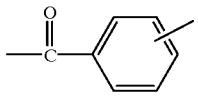

wherein $R_1$ is a $C_1$–$C_3$ alkylene group. Preferred compounds include $C_9$–$C_{11}$ alkyl ether polyethenoxy (7–9) C(O) $CH_2CH_2COOH$, $C_{13}$–$C_{15}$ alkyl ether polyethenoxy (7–9)

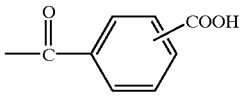

and $C_{10}$–$C_{12}$ alkyl ether polyethenoxy (5–7) $CH_2COOH$. These compounds may be prepared by considering ethylene oxide with appropriate alkanol and reacting this reaction product with chloracetic acid to make the ether carboxylic acids as shown in U.S. Pat. No. 3,741,911 or with succinic anhydride or phthalic anhydride. Obviously, these anionic surfactants will be present either in acid form or salt form depending upon the pH of the final composition, with salt forming cation being the same as for the other anionic surfactants.

Of the foregoing anionic surfactants used in forming the analephotropic complex, the preferred surfactants are the sodium or magnesium salts of the $C_8$–$C_{18}$ alkyl sulfates such as magnesium lauryl sulfate and sodium lauryl sulfate and mixtures thereof.

Generally, the proportion of the anionic surfactant will be in the range of 0.1 to 21 wt. %, preferably from 1 to 15 wt. %, by weight of the cleaning composition.

The instant composition contains as part of the analephotropic negatively charged complex about 0.1 to about 21 wt. %, preferably about 1 to about 15 wt. % of a nonionic surfactant.

The water soluble nonionic surfactants utilized in this invention are commercially well known and include the primary aliphatic alcohol ethoxylates and secondary aliphatic alcohol ethoxylates. The nonionic synthetic organic surfactants generally are the condensation products of an organic aliphatic hydrophobic compound and hydrophilic ethylene oxide groups. Any hydrophobic compound having a hydroxy group can be condensed with ethylene oxide or with the polyhydration product thereof, polyethylene glycol, to form a water soluble nonionic surfactant.

The nonionic surfactant class includes the condensation products of a higher alcohol (e.g., an alkanol containing about 8 to about 18, more preferably about 8 to about 12, carbon atoms in a straight or branched chain configuration) condensed with about 10 to 20 moles of ethylene oxide, for example, decyl, lauryl or myristyl alcohol condensed with about 12 moles of ethylene oxide (EO), myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 10 moles of EO per mole of total alcohol or about 10 moles of EO per mole of alcohol.

A preferred group of the foregoing nonionic surfactants are the Neodol ethoxylates (Shell Co.), which are higher aliphatic, primary alcohol containing about 8 to 15 carbon atoms, such as $C_9$–$C_{11}$ alkanol condensed with at least 10 moles of ethylene oxide for example, $C_{9\text{-}11}$ alkanol condensed with 12 moles ethylene oxide (Neodol 91-12). Such ethoxamers have an HLB (hydrophilic/lipophilic balance) value of about 13 to 18 and give good O/W emulsification, whereas ethoxamers with HLB values below 12 contain less than 8 ethylene oxide groups and tend to be less effective emulsifiers and poor detergents.

The instant compositions contain 0 to about 10 wt. %, more preferably about 0.5 wt. % to about 9.0 wt. % of a Lewis base, neutral polymer which is soluble in water and has either a nitrogen or oxygen atom with a pair of free electrons such that the Lewis base, neutral polymer can electronically associate with the anionic surfactant or an active ingredient present in the composition at a concentration of about 0.1 wt. % to about 5.0 wt. %, wherein the active ingredient is a perfume or an antimicrobial agent such as triclosan or an insect repellant such as MNDA wherein the Lewis base, neutral polymer is deposit and anchors onto the surface of the surface being cleaned thereby holding the anionic surfactant or active ingredient in close proximity to the surface being cleaned and in the case of the active ingredient ensuring that the properties being parted by the active ingredient last longer.

The Lewis base, neutral polymers are selected from the group consisting of an alkoxylated polyhydric alcohol, a polyvinyl pyrrolidone and a polyethylene glycol. The alkoxylated polyhydric alcohol is depicted by the following formula

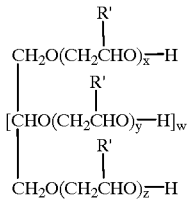

wherein w equals one to four and x, y and z have a value between 0 and 60, more preferably 0 to 40, provided that (x+y+z) equals about 2 to about 100, preferably about 4 to about 24 and most preferably about 4 to about 19, and wherein R' is either hydrogen atom or methyl group. A preferred ethoxylated polyhydric alcohol is glycerol 6EO.

The polyvinyl pyrrolidone is depicted by the formula:

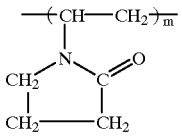

wherein m is about 20 to about 350 more preferably about 70 to about 110.

The polyethylene glycol is depicted by the formula $$HO(CH_2—CH_2O—)_nH$$

wherein n is about 8 to about 225, more preferably about 10 to about 180, wherein PEG600 or PEG400 are preferred which are a polyethylene glycols having a molecular weight of about 600 and about 400 respectively.

The final essential ingredient in the hard surface cleaning compositions having improved interfacial tension properties is water. The proportion of water in the hard surface cleaning compositions generally is in the range of 20 wt. % to 97 wt. %, preferably 70 wt. % to 97 wt. %.

The present invention also relates to a light duty liquid composition which comprises approximately by weight:

(a) 3% to 40% of the previously defined analephotropic negative charged complex;

(b) 0 to 10% of a Lewis base, neutral polymer; and (c) the balance being water.

The instant compositions excluded the use of anionic polymers and cationic polymers and zwitterionic surfactants as well as cosurfactants such as glycol ethers and the instant compositions do not contain grease release agents such as choline chloride or a mixture of an ethoxylated glycerol with the mono-, di- and tri-esters of the ethoxylated glycerol, or more than 0.35 wt. % of a perfume and the instant compositions are not microemulsions.

In addition to the above-described essential ingredients required for the formation of the all purpose hard surface cleaning compositions, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level.

Thus, depending on such factors as the pH of the system and the nature of the analephotropic complex, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

The proportion of the multivalent salt generally will be selected so that at the appropriate weight ratio between the anionic surfactant and the nonionic surfactant, to deliver desired performance from the analephotropic surfactant mixture in terms of adsorption properties on grease surface, the physical stability of the total composition is kept, that can be impaired due to an increased hydrophobicity of the analephotropic complex in the presence of multivalent salt instead of alkali metal cation such as the sodium salt thereof. As a consequence, the proportion of the multivalent salt will be selected so that the added quantity will neutralize from 0.1 to 1.5 equivalents of the anionic surfactant, preferably 0.9 to 1.4 equivalents of the acid form of the anionic surfactant. At higher concentrations of anionic surfactant, the amount of multivalent salt will be in range of 0.5 to 1 equivalents per equivalent of anionic surfactant.

The hard surface cleaning compositions can optionally include from 0 to 2.5 wt. %, preferably from 0.1 wt. % to 2.0 wt. % of the composition of a $C_8$–$C_{22}$ fatty acid or fatty acid soap as a foam suppressant. The addition of fatty acid or fatty acid soap provides an improvement in the rinseability of the composition whether applied in neat or diluted form. Generally, however, it is necessary to increase the level of cosurfactant to maintain product stability when the fatty acid or soap is present. If more than 2.5 wt. % of a fatty acid is used in the instant compositions, the composition will become unstable at low temperatures as well as having an objectionable smell.

As example of the fatty acids which can be used as such or in the form of soap, mention can be made of distilled coconut oil fatty acids, "mixed vegetable" type fatty acids (e.g. high percent of saturated, mono-and/or polyunsaturated $C_{18}$ chains); oleic acid, stearic acid, palmitic acid, eiocosanoic acid, and the like, generally those fatty acids having from 8 to 22 carbon atoms being acceptable.

The all-purpose liquid cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

In final form, the all-purpose cleaning compositions exhibit stability at reduced and increased temperatures. More specifically, such compositions remain clear and stable in the range of 40° C. to 50° C., especially 10° C. to 43° C. Such compositions exhibit a pH in the acid or neutral range depending on intended end use. The liquids are readily pourable and exhibit a viscosity in the range of 6 to 60 millipascal·Second (mPas.) as measured at 25° C. with a Brookfield RVT Viscometer using a #1 spindle rotating at 20 RPM. Preferably, the viscosity is maintained in the range of 10 to 40 mPas.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

Because the compositions as prepared are aqueous liquid formulations and since no particular mixing is required to form the all purpose cleaning composition, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents can be separately prepared and combined with each other and with the perfume. The magnesium salt, or other multivalent metal compound, when present, can be added as an aqueous solution thereof or can be added directly. It is not necessary to use elevated temperatures in the formation step and room temperature is sufficient.

The instant all purpose cleaning compositions explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

It is contemplated within the scope of the instant invention that the instant analephotropic negatively charged complex can be employed in hard surface cleaning compositions such as wood cleaners, window cleaners and light duty liquid cleaners.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared:

| Raw Materials | A | B | C | D | E |
|---|---|---|---|---|---|
| Sodium paraffin sulfonate $C_{14}$–$C_{17}$ (60%) | 7.0 | — | — | 3.5 | — |
| Sodium $C_9$–$C_{13}$ linear alkylbenzene sulfonate (LAS) (52%) | — | 7.0 | — | — | 2.3 |
| Neodol 91–12($C_{9-11}$ E12) | — | — | 7.0 | 3.5 | 4.7 |
| Water | Bal. | Bal. | Bal. | Bal. | Bal. |
| Concentration (mmol/liter) of complex of anionic surfactant and nonionic surfactant which provides an adhesion tension of 10 mN/m | 0.98 | 2.07 | 0.87 | 0.54 | 0.78 |

Cleaning performance were performed at 25° C. on Samples D–E

| Tests | D | E |
|---|---|---|
| % Particulate soil removal "Kaolin" soil[a] | 69 | 96 |

[a]"Kaolin" particulate soil composition: 70 g mineral oil, 35 g kaolin and 35 g tetrachloroethylene as solvent carrier (tetrachloroethylene is removed in an oven at 80° C. prior to run the test). Kaolin is medium particle size china clay from ECC International - grade E powder - 65% minimum below 10 microns, with 0.05% maximum above 53 microns.

EXAMPLE 2

The following compositions in wt. % were prepared:

| Raw Materials | F | G | H | I | J |
|---|---|---|---|---|---|
| Magnesium $C_9$—$C_{13}$ linear alkylbenzene sulfonate (LAS) (50%) | 5.34 | 5.34 | 5.34 | 5.34 | 5.34 |
| Neodol 25-7 ($C_{12-15}$ E7) | 1.33 | 1.33 | 1.33 | 1.33 | 1.33 |
| Urea | — | 1.5 | — | — | — |
| Sodium xylene sulfonate (93%) | — | — | 2.0 | — | — |
| Sodium cumene sulfonate (40% solution) | — | — | — | 2.0 | — |
| Ethoxyated (4.5 EO) C12–C14 diethanol amide | — | — | — | — | 2.0 |
| Polyethylene gycol 400 (PEG 400) | 4.7 | 4.7 | 4.7 | 4.7 | 4.7 |
| Neutralized C12–C14 (coco) fatty acid | 0.25 | 0.25 | 0.25 | 0.25 | 0.25 |
| Perfume | 0.20 | 0.20 | 0.20 | 0.20 | 0.20 |
| Water | Bal. | Bal. | Bal. | Bal. | Bal. |

Composition F in Example 2 has been found hazy at room temperature without addition of solubilizer.

Cleaning performance were performed at 25° C. on Samples G–J

| Tests | G | H | I | J |
|---|---|---|---|---|
| % Particulate soil removal "Kaolin" soil[a] | 77 | 75 | 74 | 45 |

[a]"Kaolin" particulate soil composition: 70 g mineral oil, 35 g kaolin and 35 g tetrachloroethylene as solvent carrier (tetrachloroethylene is removed in an oven at 80° C. prior to run the test). Kaolin is medium particle size china clay from ECC International - grade E powder - 65% minimum below 10 microns, with 0.05% maximum above 53 microns.

EXAMPLE 3

The following compositions in wt. % were prepared:

| Raw Materials | A | K | L | M | N | O | P | Q | R | S |
|---|---|---|---|---|---|---|---|---|---|---|
| Sodium paraffin sulfonate $C_{14}$–$C_{17}$ (60%) | 7.0 | — | — | — | — | 3.5 | 3.5 | 3.5 | — | — |
| Sodium lauryl sulfate (99%) | — | 7.0 | — | — | — | — | — | 3.5 | — | |
| NaAEOS (1.3:1) (26.54%) | — | — | — | — | — | — | — | — | — | 3.5 |
| Neodol 91–12 ($C_{9-11}$ E12) | — | — | — | — | — | — | — | 3.5 | 3.5 | |
| Neodol 45–18 ($C_{14-15}$ E18) | — | — | 7.0 | | — | 3.5 | — | — | — | |
| Tween 40 (polyoxyethylene (20EO) sorbitan palmitate ester) | — | — | — | 7.0 | — | — | 3.5 | — | — | — |
| Synperonic A20 ($C_{13-15}$ E20) | — | — | — | — | 7.0 | — | — | 3.5 | — | — |
| Water | Bal. | Bal. | Bal. | Bal. | Bal. | Bal. | Bal. | Bal. | Bal. | Bal. |
| Concentration (mmol/liter) of complex of anionic surfactant and nonionic surfactant which provides an adhesion tension of 10 mN/m | 0.98 | 6.94 | 0.26 | 0.26 | 0.12 | 0.15 | 0.54 | 0.43 | 1.11 | 1.04 |

Cleaning performance were performed at 25° C. on Samples O–Q

| Tests | O | P | Q |
|---|---|---|---|
| % Particulate soil removal "Kaolin" soil[a] | 67 | 91 | 66 |

[a]"Kaolin" particulate soil composition: 70 g mineral oil, 35 g kaolin and 35 g tetrachloroethylene as solvent carrier (tetrachloroethylene is removed in an oven at 80° C. prior to run the test). Kaolin is medium particle size china clay from ECC International - grade E powder - 65% minimum below 10 microns, with 0.05% maximum above 53 microns.

What is claimed:

1. A cleaning composition consisting of:

(a) about 3.0 wt. % to about 40 wt. % of an analephotropic negatively charged comlplex comprising:

(i) at least one anionic surfactant selected from the group consisting of alkali metal salts of sulfonates, alkali metal salts of sulfates, alkaline earth metal salts of sulfonates and alkaline earth metal salts of sulfates; and (ii) an ethoxylated nonionic surfactant having at least 10 ethylene oxide groups, said anionic surfactant and said nonionic surfactant being a weight ratio of 2:1 to 0.4:1;

(b) 0.5 to 9% of a Lewis base, neutral polymer which is selected from the group of an ethoxylated glycerol, polyethylene glycol and polyvinyl pyrrolidone; and (c) the balance being water, wherein the composition is not a microemulsion.

2. The cleaning composition of claim 1 wherein the anionic surfactant is a $C_{10}$–$C_{16}$ alkyl benzene sulfonate or a $C_{10}$–$C_{20}$ alkane sulfonate.

* * * * *